US011330915B2

(12) United States Patent
Sclare

(10) Patent No.: US 11,330,915 B2
(45) **Date of Patent: *May 17, 2022**

(54) DEPTH-ADJUSTABLE BASSINET

(71) Applicant: KIDS II, INC., Atlanta, GA (US)

(72) Inventor: Jacob Sclare, Dacula, GA (US)

(73) Assignee: KIDS2, INC., Atlanta, GA (US)

( * ) Notice: Subject to any disclaimer, the term of this patent is extended or adjusted under 35 U.S.C. 154(b) by 204 days.

This patent is subject to a terminal disclaimer.

(21) Appl. No.: 16/508,634

(22) Filed: Jul. 11, 2019

(65) Prior Publication Data

US 2019/0328151 A1 Oct. 31, 2019

Related U.S. Application Data

(63) Continuation of application No. 15/083,487, filed on Mar. 29, 2016, now Pat. No. 10,383,455.

(60) Provisional application No. 62/215,943, filed on Sep. 9, 2015, provisional application No. 62/152,845, filed on Apr. 25, 2015, provisional application No. 62/139,858, filed on Mar. 30, 2015.

(51) Int. Cl.
*A47D 9/00* (2006.01)
*A47D 7/03* (2006.01)

(52) U.S. Cl.
CPC ..... *A47D 9/00* (2013.01); *A47D 7/03* (2013.01)

(58) Field of Classification Search
CPC ..... A61G 7/012; A47D 7/03; A47D 9/00; A47D 9/005; A47C 17/645
See application file for complete search history.

(56) References Cited

U.S. PATENT DOCUMENTS 22,056 A 11/1858 Ball
41,507 A 2/1864 Helmkamn
(Continued)

FOREIGN PATENT DOCUMENTS

GB 2422303 A 7/2006
GB 2429400 A 2/2007
(Continued)

OTHER PUBLICATIONS

Extended European Search Report for EP App. No. 16162926.6; dated Jun. 8, 2016; 7 pgs.

*Primary Examiner* — Eric J Kurilla
(74) *Attorney, Agent, or Firm* — Gardner Groff & Greenwald, PC

(57) ABSTRACT

A frame is configured to rest on a support surface and an infant-receiving receptacle is supported above the support surface by the frame. The infant-receiving receptacle includes a bottom/floor panel forming a bed for the child to sleep upon and a peripheral sidewall surrounding the bottom panel and extending between the bottom panel and the frame. The bassinet includes a depth-adjustment mechanism that enables a caregiver to selectively adjust the depth of the infant-receiving receptacle by raising or lowering the bottom panel of the infant-receiving receptacle. Various embodiments can also include wheels, rollers, or other mechanisms for rolling, sliding, or gliding the bassinet across the support surface. Some embodiments include a height-adjustment mechanism, downward-recessed front wall, longitudinal-axis folding canopy, inverted-eggcrate bed pad, and/or base-positioned foot rest.

17 Claims, 12 Drawing Sheets

(56) References Cited

U.S. PATENT DOCUMENTS 54,815 A 5/1866 Brazelle
81,757 A 9/1868 Delano
171,900 A 1/1876 Wilson et al.
362,850 A 5/1887 Morris
371,700 A 10/1887 Ordway
884,509 A 4/1908 Lindsey
909,113 A 1/1909 Philia et al.
RE13,719 E 4/1914 Taylor
1,401,229 A 12/1921 Zubryd
1,574,226 A 2/1926 Ackermann
1,618,493 A 2/1927 Thiele
1,704,914 A 3/1929 Fairweather
1,881,579 A 10/1932 Hoch et al.
1,897,258 A 2/1933 Jenne
2,235,293 A 3/1941 Mellon
2,553,579 A 5/1951 Harris
2,590,315 A 3/1952 Hawley, Jr.
2,645,790 A 7/1953 Hayes
2,793,375 A 5/1957 Wardell, Jr.
2,806,397 A 9/1957 Nichols, Jr.
2,873,458 A 2/1959 Adamson
3,004,793 A 10/1961 Loomis
3,031,686 A 5/1962 Muzzey
3,092,847 A 6/1963 De Puy
3,127,620 A 4/1964 Peterson
3,146,736 A 9/1964 Hetrick
3,156,932 A 11/1964 Mautner
3,162,460 A 12/1964 Davidson
3,162,865 A 12/1964 Tigrett
3,309,719 A * 3/1967 Bader ..... A47D 11/007 5/98.1
3,541,618 A 11/1970 Johnson et al.
3,763,507 A 10/1973 Propst
3,780,387 A 12/1973 Propst
3,789,439 A 2/1974 Berg et al.
3,848,277 A 11/1974 Reguitti
3,874,005 A 4/1975 Badon
3,886,608 A 6/1975 Casella
3,921,233 A 11/1975 Mann
4,302,857 A 12/1981 Kodet et al.
4,419,777 A 12/1983 Parker
D288,679 S 3/1987 Moskin et al.
4,775,184 A 10/1988 Larkin
4,793,010 A 12/1988 Gross et al.
D300,787 S 4/1989 Carter
4,823,415 A 4/1989 Lampard
4,985,949 A 1/1991 Jantz
5,161,273 A 11/1992 Deck
5,473,785 A 12/1995 Lager et al.
D398,161 S 9/1998 Rosenbaum
5,802,634 A 9/1998 Onishi et al.
5,806,113 A 9/1998 McMahan et al.
5,819,340 A 10/1998 Kelly
5,957,436 A 9/1999 Ristau
6,148,456 A 11/2000 Tharalson et al.
6,202,228 B1 3/2001 Cox
6,301,731 B1 10/2001 Jakubowski et al.
6,339,855 B1 1/2002 Socha et al.
6,386,986 B1 * 5/2002 Sonner ..... A47D 9/02 297/273
6,412,867 B2 7/2002 Robinson
6,434,768 B2 8/2002 Brown et al.
6,438,772 B1 8/2002 Brown et al.
6,470,516 B2 10/2002 Lopez, Jr.
6,510,570 B2 1/2003 Hartenstine
6,560,795 B2 5/2003 Hsia
6,574,812 B2 6/2003 Jakubowski et al.
6,578,211 B2 6/2003 Tharalson et al.
6,682,137 B2 1/2004 Hsia
6,701,547 B2 3/2004 Hsia
6,704,949 B2 3/2004 Waldman et al.
6,728,980 B1 5/2004 Chen
D491,736 S 6/2004 Kane et al.
6,811,217 B2 11/2004 Kane et al.
6,854,800 B2 2/2005 Perego
6,901,613 B1 6/2005 Hsia
6,934,981 B2 8/2005 Waldman et al.
7,013,505 B2 3/2006 Martin
7,017,203 B2 3/2006 Chen
RE39,136 E 6/2006 Tharalson et al.
7,325,872 B2 2/2008 Basu et al.
7,404,219 B2 7/2008 Berkey
7,415,739 B2 8/2008 Tharalson et al.
7,537,285 B2 5/2009 Stewart
D605,870 S 12/2009 Bergkvist et al.
7,739,759 B2 6/2010 Mendes et al.
7,752,693 B2 7/2010 Espenshade
7,788,744 B2 9/2010 Calilung et al.
7,818,832 B2 10/2010 Hartenstine et al.
7,882,579 B2 2/2011 Jackson et al.
8,112,835 B2 2/2012 Eirich et al.
8,141,186 B2 3/2012 Burns et al.
D660,053 S 5/2012 Sclare et al.
8,201,291 B2 6/2012 Burns et al.
8,291,530 B2 10/2012 Burkholder et al.
D678,693 S 3/2013 Bergkvist et al.
8,429,771 B2 4/2013 Long
8,484,774 B2 7/2013 Cohen et al.
8,484,776 B1 7/2013 Su
8,528,130 B2 9/2013 Bu et al.
8,555,434 B2 10/2013 Chapman et al.
8,566,988 B2 10/2013 Son et al.
8,657,326 B2 * 2/2014 Shaanan ..... B62B 9/108 280/644
8,677,526 B2 3/2014 Li
8,745,780 B2 6/2014 Su
8,756,728 B2 6/2014 Bergkvist
8,801,098 B1 8/2014 Richards
8,844,072 B2 9/2014 Bellows et al.
D717,574 S 11/2014 Bellows et al.
D717,577 S 11/2014 Pacella et al.
8,950,020 B2 2/2015 D'Arrigo
9,021,629 B2 5/2015 Cheng
9,095,228 B2 8/2015 Gooris
9,101,226 B1 8/2015 Hartenstine et al.
9,113,723 B2 8/2015 Greger et al.
9,149,128 B2 10/2015 Rampton et al.
9,198,524 B2 12/2015 Horst et al.
9,226,594 B2 1/2016 Long
9,241,581 B2 1/2016 O'Nion
9,565,950 B2 2/2017 Horst et al.
9,574,647 B2 2/2017 Tundo et al.
9,585,493 B2 3/2017 Haut et al.
9,610,966 B2 4/2017 Zhong
9,883,750 B2 2/2018 Yi
9,888,786 B2 2/2018 Corso et al.
9,986,849 B2 6/2018 Sclare
10,154,737 B2 12/2018 Horst et al.
10,219,634 B2 3/2019 Yang
10,383,455 B2 * 8/2019 Sclare ..... A47D 7/03
2005/0210580 A1 9/2005 Clapper
2005/0264063 A1 12/2005 Babcock et al.
2006/0000019 A1 1/2006 Martin
2007/0006910 A1 1/2007 Chu et al.
2007/0007804 A1 1/2007 Pemberton et al.
2007/0271697 A1 11/2007 Martin
2008/0022457 A1 1/2008 Wu
2009/0077742 A1 3/2009 Burns et al.
2009/0200846 A1 8/2009 Yehuda
2009/0206637 A1 8/2009 Lo
2010/0001566 A1 1/2010 Yehuda
2010/0218312 A1 9/2010 Quintas Mendes
2010/0263121 A1 10/2010 Arnold, IV et al.
2011/0148155 A1 6/2011 Chapman et al.
2011/0308011 A1 12/2011 Cheng et al.
2012/0216347 A1 8/2012 Tundo et al.
2013/0117930 A1 5/2013 Hsu
2013/0214574 A1 8/2013 Chapman et al.
2014/0101847 A1 4/2014 von Rohrscheidt et al.
2014/0208503 A1 * 7/2014 Horst ..... A47D 7/01 5/93.1
2014/0215712 A1 8/2014 Xu et al.

(56) References Cited

U.S. PATENT DOCUMENTS

| | | | |
|---|---|---|---|
| 2016/0227939 | A1 | 8/2016 | Tadipatri et al. |
| 2016/0286979 | A1 | 10/2016 | Sclare |
| 2017/0251827 | A1 | 9/2017 | Gallina |

FOREIGN PATENT DOCUMENTS

| | | | |
|---|---|---|---|
| GB | 2501526 | A | 10/2013 |
| NL | 1015897 | C1 | 2/2002 |
| WO | 2006063977 | | 6/2006 |

* cited by examiner

DEPTH-ADJUSTABLE BASSINET

CROSS-REFERENCE TO RELATED APPLICATIONS

This application is a continuation of U.S. Non-Provisional patent application Ser. No. 15/083,487 filed Mar. 29, 2016, which claims the benefit of U.S. Provisional Patent Application Ser. No. 62/139,858 filed Mar. 30, 2015; U.S. Provisional Patent Application Ser. No. 62/152,845 filed Apr. 25, 2015; and U.S. Provisional Patent Application Ser. No. 62/215,943 filed Sep. 9, 2015, the entireties of which are hereby incorporated herein by reference for all purposes.

TECHNICAL FIELD

The present invention relates generally to the field of infant and children's products, and more particularly to sleeping apparatuses for children.

BACKGROUND

Bassinets have long been used for safely holding infant children while they sleep. Bassinets typically have a frame configured to rest on a support surface (e.g., a floor) and an infant-receiving receptacle supported above the support surface by the frame. The infant-receiving receptacle includes a bottom forming a bed for the child to sleep upon and a peripheral sidewall surrounding the bottom and extending between the bottom and the frame. Also, some bassinets include a canopy or hood.

Oftentimes caretakers (e.g., parents) will place an infant child in a bassinet in the parent's bedroom at night for sleeping so they are nearby if the baby needs them and to maintain sound (e.g., voice) contact with the infant to enhance the bonding process. And many parents strive to maintain visual (i.e., eye to eye) contact and/or physical (i.e., touching) contact with their infant to enhance the bonding process. However, the peripheral sidewall of the standard-height bassinets impedes such visual and/or physical contact. Moreover, while conventional bassinets provide numerous benefits, there remains room for improvement in general in bassinet design.

Accordingly, it can be seen that needs exist for improvements in bassinets. It is to the provision of solutions meeting these and other needs that the present invention is primarily directed.

SUMMARY

Generally described, the invention relates to a child-sleeping apparatus such as a bassinet. The bassinet includes a frame that is configured to rest on a support surface (e.g., a floor) and an infant-receiving receptacle that is supported above the support surface by the frame. The infant-receiving receptacle includes a bottom floor panel forming a bed for the child to sleep upon and a peripheral sidewall surrounding the bottom panel and extending between the bottom panel and the frame. Optionally, the frame can also include wheels, rollers, or other mechanisms for rolling, sliding, or gliding the bassinet across the support surface.

In addition, the bassinet includes a depth-adjustment mechanism that enables a caregiver to selectively adjust the depth of the infant-receiving receptacle by raising or lowering the bottom of the infant-receiving receptacle. With the bottom panel in the raised position, the bassinet functions as a conventional bassinet. And with the bottom panel in the lowered position, the child can sit or stand up within the infant-receiving receptacle (without risk of falling out of the bassinet) and see over the peripheral sidewall to enhance parent-child bonding. Also, in some embodiments the bassinet can be positioned with the frame adjacent a bed and the child-receiving receptacle at least partially over the bed to position the child closer to the parent to enhance parent-child bonding.

Furthermore, in some embodiments the bassinet includes a frame height-adjustment mechanism, a downward-recessed front wall, and/or a longitudinal-axis folding canopy to assist in enhancing parent-child bonding with a child in the bassinet. Also, in some embodiments the bassinet includes a foot rest for use when raising the bottom of the infant-receiving receptacle and/or an inverted-eggcrate bed pad for enhanced comfort for the child lying on it.

These and other aspects, features, and advantages of the invention will be understood with reference to the drawing figures and detailed description herein, and will be realized by means of the various elements and combinations particularly pointed out in the appended claims. It is to be understood that both the foregoing general description and the following brief description of the drawings and detailed description of example embodiments are explanatory of representative embodiments of the invention, and are not restrictive of the invention, as claimed.

DETAILED DESCRIPTION OF EXAMPLE EMBODIMENTS

Figure 1:
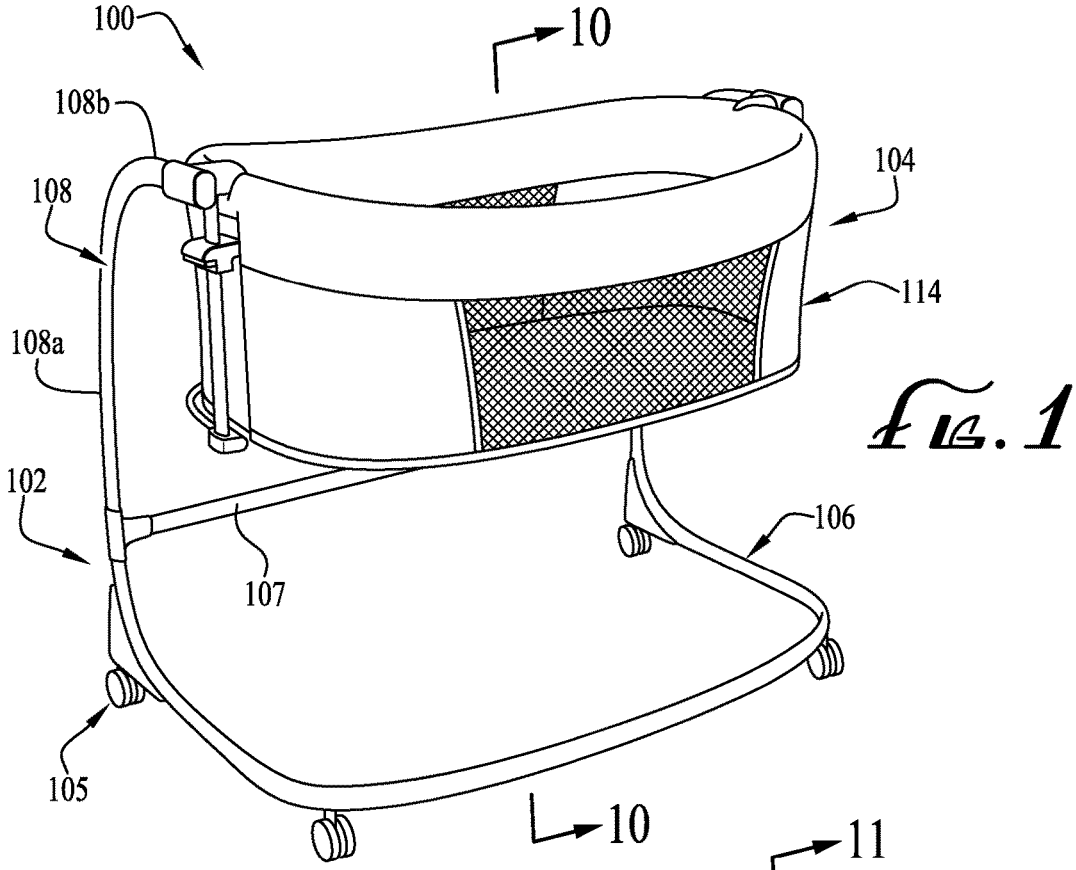
FIG. 1 is a perspective view of a bassinet according to a first example embodiment of the invention, shown with the bottom/floor panel in a raised position for conventional use by a child lying down.
Figure 2:
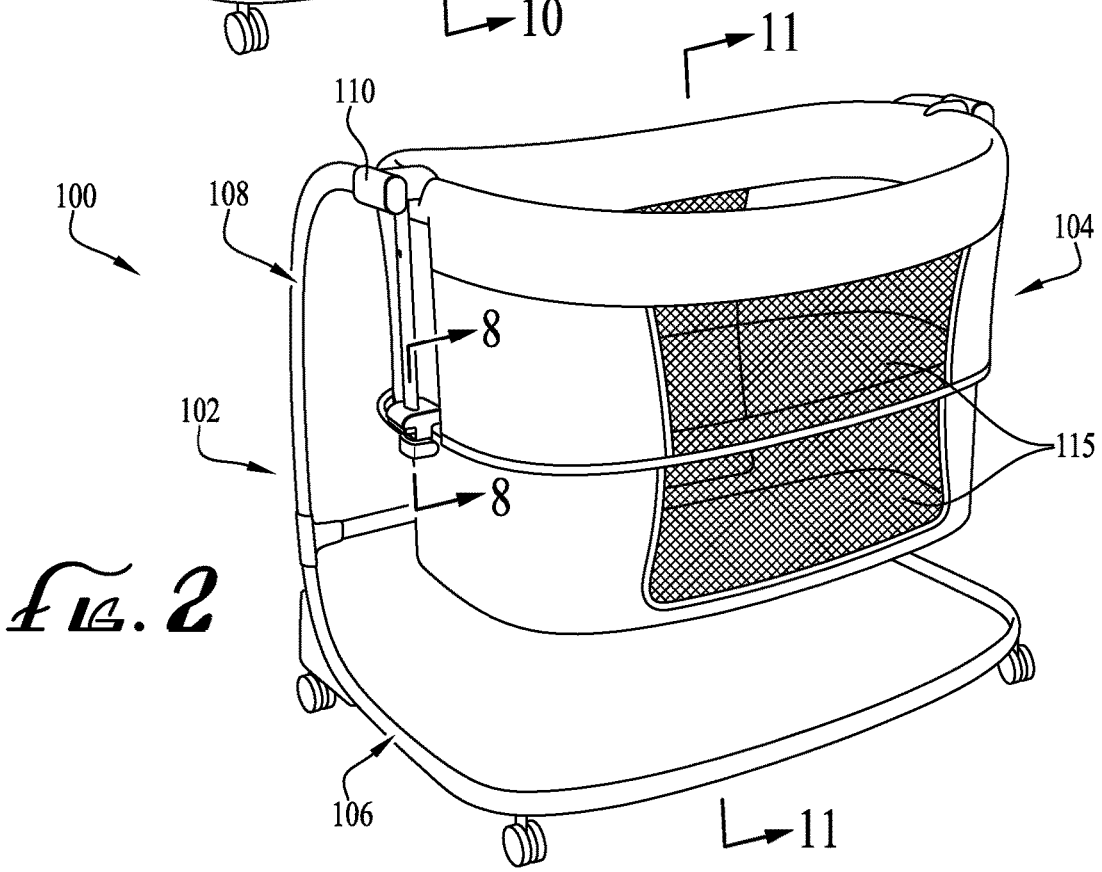
FIG. 2 shows the bassinet of FIG. 1 with the bottom panel in a lowered position for use by a child lying down or standing/sitting up.
Figure 3:
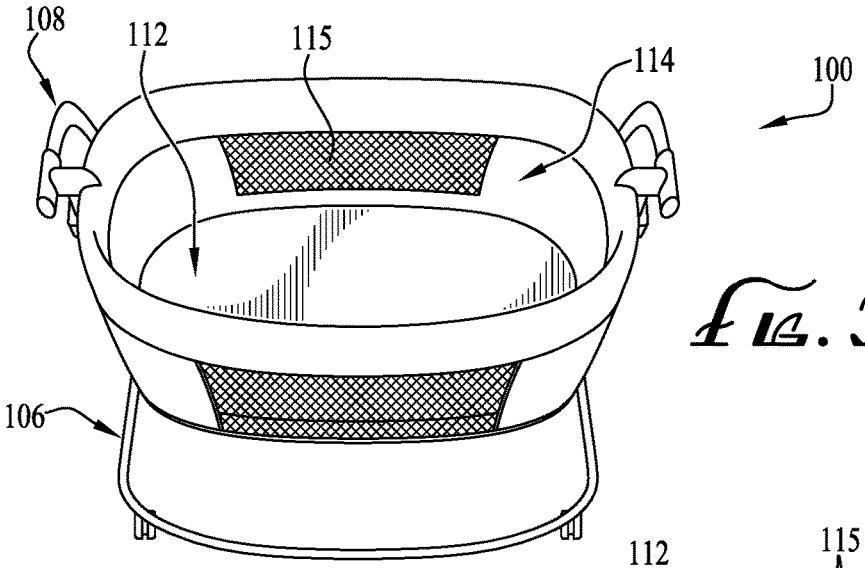
FIG. 3 is another perspective view of the bassinet of FIG. 1 shown with the bottom panel in the raised position.
Figure 4:
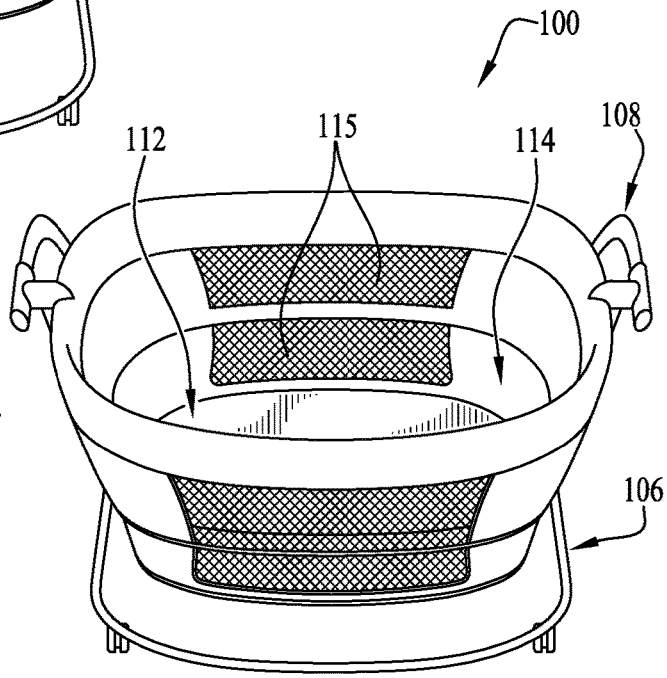
FIG. 4 shows the bassinet of FIG. 3 with the bottom panel in the lowered position.
Figure 5:
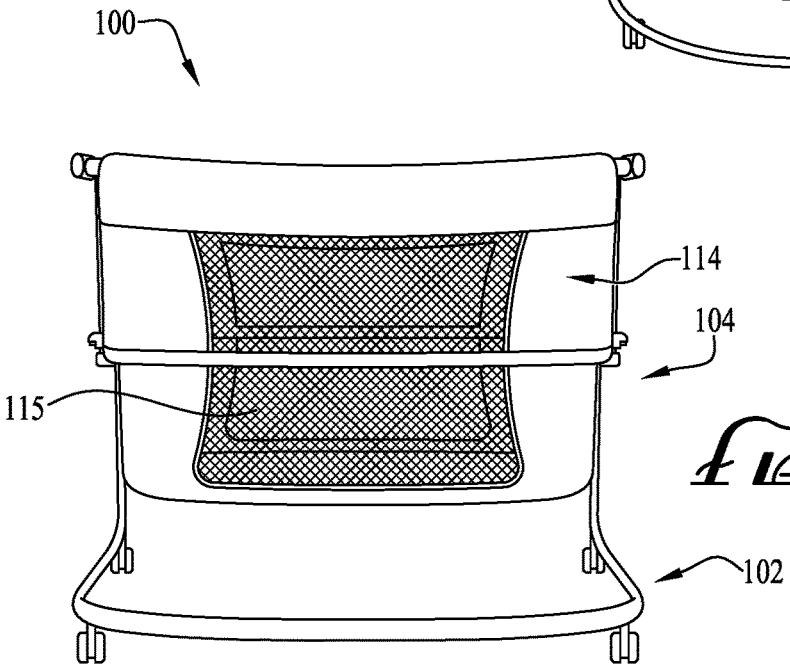
FIG. 5 is a front side view of the bassinet of FIG. 1 shown with the bottom panel in the lowered position.
Figure 6:
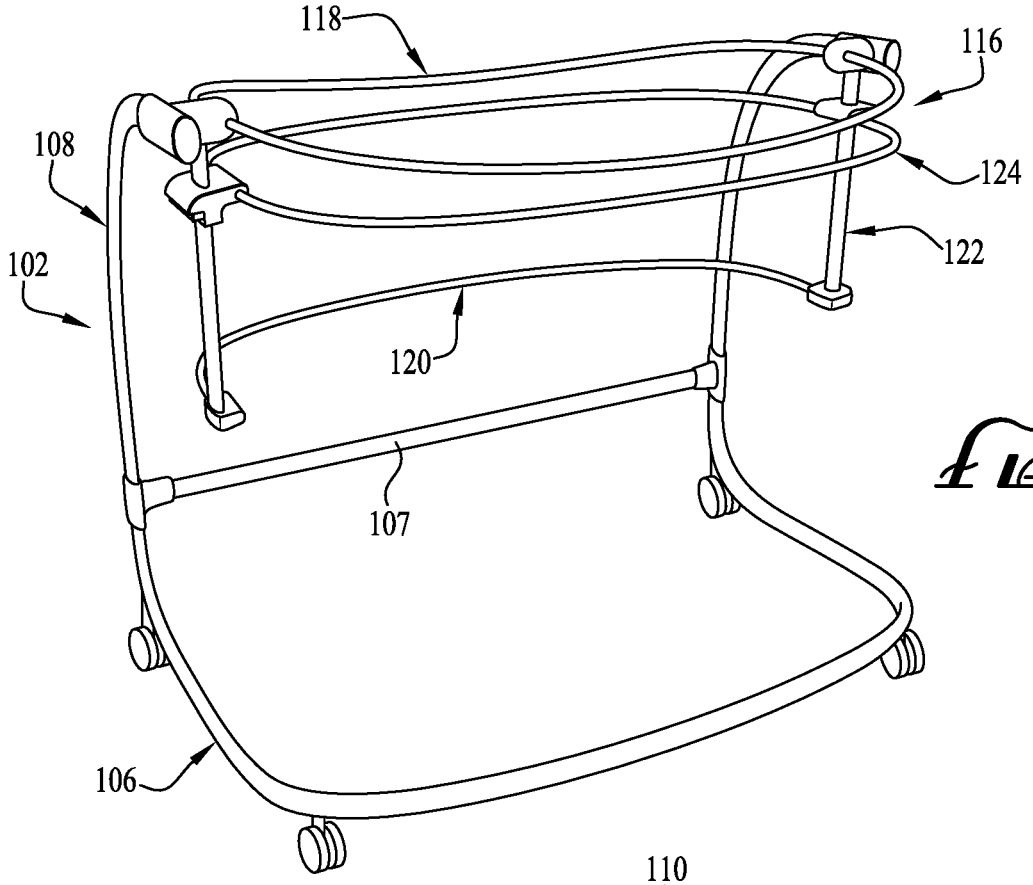
FIG. 6 is a perspective view of a frame assembly of the bassinet of FIG. 1, showing a depth-adjustment mechanism in the raised-bottom position.
Figure 7:
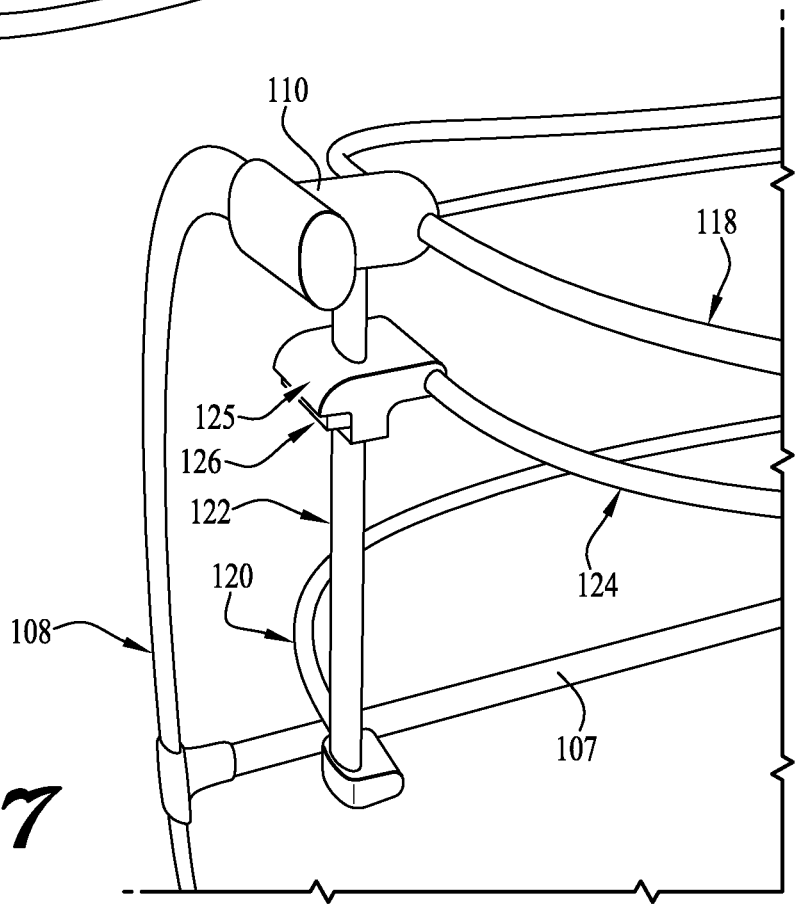
FIG. 7 is a perspective view of a portion of the bassinet frame assembly of FIG. 6 with the depth-adjustment mechanism in the raised-bottom position.
Figure 9:
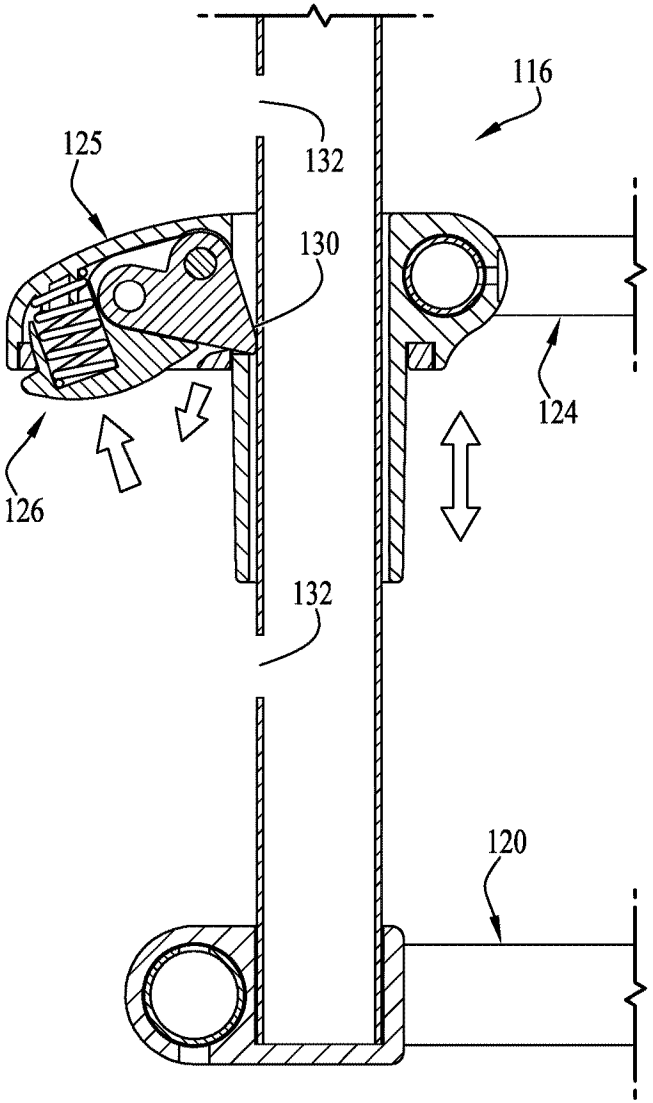
FIG. 9 shows the bassinet frame portion of FIG. 8 with the depth-adjustment mechanism being operated to move the bassinet bottom panel to the raised position.
Figure 8:
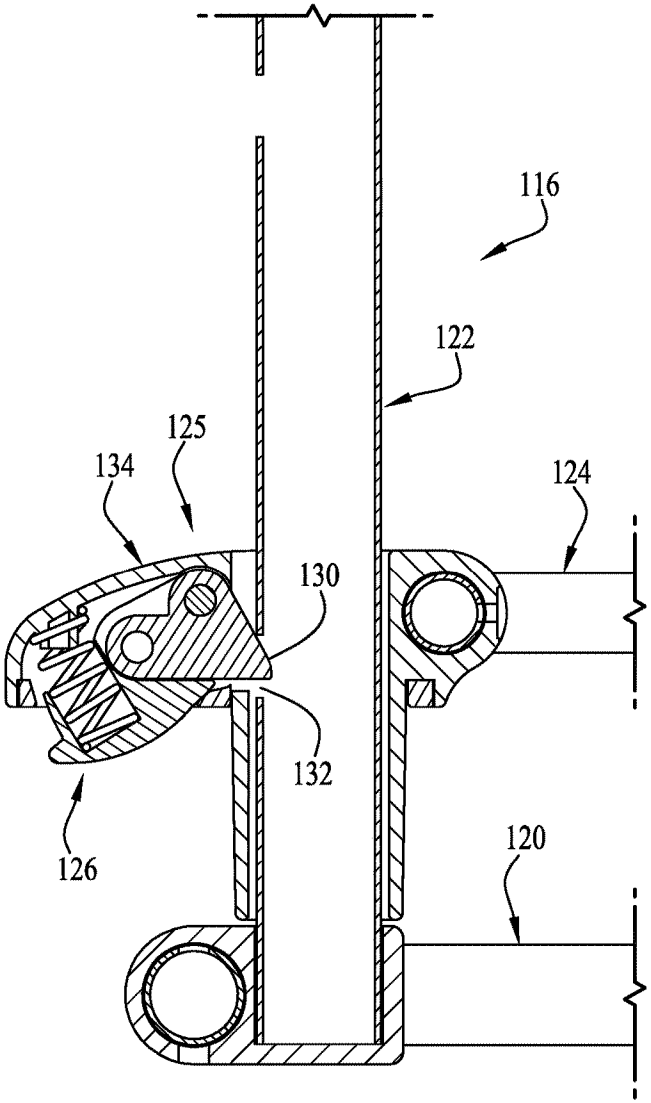
FIG. 8 is a longitudinal cross-sectional view of a portion of the bassinet frame assembly taken at line 8-8 of FIG. 2, showing the depth-adjustment mechanism in the lowered-bottom position.

The present invention may be understood more readily by reference to the following detailed description taken in connection with the accompanying drawing figures, which form a part of this disclosure. It is to be understood that this invention is not limited to the specific devices, methods, conditions, or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

Moreover, various innovative features of the present invention are described herein with respect to a bassinet. It will be understood that any or all of these innovative features can be implemented in other (than bassinets) apparatuses for supporting and containing a sleeping child, for example cradles, cribs, and play yards.

With reference now to the drawing figures, wherein like reference numbers represent corresponding parts throughout the several views, FIGS. 1-12 show a bassinet 100 according to a first example embodiment of the invention. The bassinet 100 includes a support-frame assembly 102 configured to rest on a support surface (e.g., a floor or the ground) and an infant-receiving receptacle 104 coupled to the support frame assembly and adapted to support a child (e.g., infant) therein.

The support frame assembly 102 includes a base portion 106 and an upright portion 108. The base portion 106 is configured to rest on a support surface and provide a stable base on which to support the other components of the bassinet 100. The upright portion 108 is coupled to and extends generally upwardly from the base portion 106. In typical embodiments such as that depicted, the base portion 106 defines a horizontal-plane footprint sufficiently large to provide stability for the infant-receiving receptacle 104 elevated and supported above it. And the upright portion 108 can include a generally vertical portion **108*a* extending upward from (only) one side of the base portion 106 (e.g., the two upright tubes extending from the rear side of the base tube, as depicted) and an offset portion 108*b* (e.g., the two horizontal tubes) extending from the vertical portion to back over the base portion typically to at least the midpoints of the ends of the infant-receiving receptacle 104 so the receptacle is supported from its end midpoints not corners. In this way, the infant-receiving receptacle 104 is stably and safely supported above the support surface by the frame-support assembly 102. And because of the one-side positioning of the upright portion 108, an empty space is left between the base portion 106 and the bottom of the infant-receiving receptacle 104 (i.e., the bassinet 100** is open on the front side and both left and right opposite ends, with the vertical support structure only at the rear side), which empty space allows for receptacle-depth adjustment and over-bed positioning functionality as discussed below.

In addition, one or more conventional wheels (e.g., casters or rollers) 105 can be coupled to the base portion 106 to allow a caregiver to roll the bassinet 100 across the support surface. The support-frame assembly 102 can also include a cross bar 107 from which clothes, towels, blankets, and other items can be hung. Various embodiments can further include storage pockets or compartments (not shown) for storing accessories such as diapers, pacifiers, bottles, wipes, and the like. In typical embodiments such as that depicted, the support-frame assembly 102 is made of conventional materials such as aluminum tubes and plastic connections.

The infant receiving receptacle 104 is coupled to the upright portion 108 of the support-frame assembly 102 and thereby supported above the support surface. For example, midpoints of the opposite (e.g. left and right) ends of the infant-receiving receptacle 104 can be mounted to ends of offset extension portions **108*b* of the upright portion 108 of the support-frame assembly 102. As shown in the depicted embodiment, the midpoints of the opposite ends of the infant-receiving receptacle 104 can be pivotally coupled to the offset portions 108*b* of the support-frame upright portion 108 at one or more pivot mounts 110 such that the infant receiving receptacle can pivot with respect to the frame assembly 102 and impart a soothing cradling motion to a child supported therein. Alternative embodiments of the infant-receiving receptacle 104 can be configured without the ability to pivot, or can be configured for additional or alternative motions, such as bouncing or rocking. Furthermore, example embodiments of the bassinet 100 can include a height-adjustment mechanism that allows a caregiver to selectively adjust the height of the infant-receiving receptacle 104** relative to the support surface, for example as described in detail below, and/or the bassinet can be configured to collapse for easy storage and portability.

The infant-receiving receptacle 104 includes a bottom/floor panel 112 and one or more peripheral sidewalls 114 that together define an enclosure with a depth within which a child can be received/supported and with an open side (e.g., the top) through which the child can be accessed. In a typical commercial embodiment, the infant receptacle 104 includes a receptacle-frame assembly 116 that supports the peripheral sidewalls 114 and the floor panel 112, and that is mounted to the upright portion 108 of the support-frame assembly 102. For example, the receptacle-frame assembly 116 can include an upper frame member 118, a lower frame member 120, and a pair of opposing (e.g., left and right) upright frame members 122 extending therebetween. The upper frame 118 can be generally horizontally arranged and extend all the way around and define the periphery of the infant receptacle 104 (e.g., for supporting the peripheral walls 114), the lower frame 120 can be generally horizontally arranged and extend only halfway around (for stabilizing and securing together the vertical frame members 122), and the upright frame members 122 can be generally vertically arranged and positioned at midpoints of ends of the infant receptacle (for smooth and balanced depth adjustment), as depicted, or other configurations can be used as desired.

The infant receptacle 104 can be made of conventional materials such as aluminum tubes and plastic connections for the receptacle-frame assembly 116 and a soft-goods shell (e.g., flexible fabric) for the peripheral sidewalls 114. In other embodiments, the peripheral sidewalls are generally rigid and the receptacle-frame assembly is eliminated or integral to the sidewalls, the receptacle-frame assembly includes additional frame members connecting the upper and lower frames, or other variations are implemented. Example embodiments of the peripheral sidewalls 114 can include sections of a breathable see-through material (e.g., mesh fabric) 115 to allow for increased light and airflow into the receptacle 104 as well as for increased visibility into the receptacle by a caretaker. The receptacle 104 can further include a bed pad such as a mattress or other cushioning member (not shown) positioned over the floor panel 112 for supporting the child thereon, for example as described in detail below.

In addition, the bassinet 100 includes a depth-adjustment mechanism that enables a caregiver to adjust the depth of the infant receptacle 104 as desired. In typical embodiments, the depth-adjustment mechanism includes an adjustable frame member 124 and at least one releasable-lock mechanism 125 that releasably locks the adjustable frame to the receptacle-frame assembly 116. The lock mechanism 125 is mounted to the adjustable frame 124 and slidably couples it to the receptacle-frame assembly 116 to permit it to slide up and down along the receptacle-frame assembly. And the floor panel 112 of the infant receptacle 104 is supported by the adjustable frame 124, so it repositions up and down along with the adjustable frame. In example embodiments, the adjustable frame 124 extends all the way around and defines the periphery of the infant receptacle 104 (for supporting the floor panel 112), as depicted, or other configurations can be used as desired. In some embodiments, a lower adjustable frame is connected by vertical frame members to the adjustable frame 124 to provide additional support for the floor panel 112.

In some embodiments such as that depicted, the depth-adjustment mechanism includes an actuator 126 that operates the lock mechanism 125. For example, there can be two lock mechanisms 125, with one at each midpoint of each end of the infant receptacle 104, and with each lock mechanism having its own respective actuator 126, as depicted. The actuators 126 are movable between locked and unlocked positions, to manipulate the lock mechanisms 125 between locked and unlocked positions, with the adjustable frame 124 locked securely in place when the lock mechanisms are in the locked position, and with the adjustable frame released and thus free for vertical repositioning when the lock mechanisms are in the unlocked position. In other embodiments, the lock mechanism secures the adjustable frame and the attached floor panel in the raised position, but not in the lowered position, and instead a mechanical stop supports the floor panel from further downward movement but does not lock it against upward movement. In yet other embodiments, the depth-adjustment mechanism does not include an actuator, or the actuator can be considered to be an integral element of the lock mechanism, by implementing conventional fastening and/or locking mechanisms for coupling and decoupling two parts as are known to persons of ordinary skill in the art.

The depth-adjustment mechanism can be operated to selectively reposition the adjustable frame 124 between a raised position and a lowered position. In some embodiments, the adjustable frame 124 is also positionable at one or more intermediate positions. When the adjustable frame 124 is positioned in the raised position (FIGS. 1 and 3), the floor panel 112 is raised, reducing the depth of the infant receptacle 104. When the adjustable frame 124 is positioned in the lowered position (FIGS. 2 and 4-5), the floor panel is lowered, increasing the depth of the infant receptacle 104.

When the adjustable frame 124 and thus the floor panel 112 are in the raised position, the depth of the infant receptacle 104 is shallower, so the infant receptacle is adapted for containing smaller and/or younger children who are unable to sit up. And when the adjustable frame 124 is in the raised position, the raised floor panel 112 of the infant receptacle 104 can be higher than the upper surface of an adult bed 180. Depending on the height and thickness of the bed 180, often times the infant receptacle 104 can be positioned at least partially over the bed, with the base portion 106 of the support-frame assembly 102 positioned at least partially under the bed, and with the bed received within the empty space between the infant receptacle and the support frame base (see FIG. 12).

When the adjustable frame 124 and thus the floor panel 112 are in the lowered position, the depth of the infant receptacle 104 is deeper, so the infant receptacle is adapted for receiving larger and/or older children who are able to sit or pull themselves up. In this lowered position, the infant receptacle 104 can be positioned adjacent the bed 180. In alternative example embodiments, depending upon the height of the adult bed 180 and the dimensions of the bassinet 100, the infant receptacle 104 can be positionable over the bed in both the raised and lowered positions.

In typical embodiments, each of the lock mechanisms 125 includes a movable locking element 130 and a plurality of locked elements 132, with the locking element movable between a locked position (FIG. 8) in locking engagement with one of the locked elements (to define the raised or lowered position) and an unlocked position (FIG. 9) released from locking engagement with the locked elements (to permit the adjustable frame 124 to move between the raised and lowered positions). For example, each locking member 130 can be provided by a male element (e.g., a pivotal tab as depicted, or a linear plunger, a rotary screw, or the like) movably mounted to a housing 134 of the depth-adjustment mechanism that slides along the respective vertical frame members 122. And each locked member 132 can be provided by at least two female elements (e.g., holes in the respective vertical frame member 122 as depicted, recesses in the same or another part of the receptacle-frame assembly 116, voids between two protrusions, or the like), with two female elements defining discrete raised and lowered positions, and optionally with one or more intermediate female elements defining intermediate positions with the female elements typically aligned in a series. It will be understood that other types of lock mechanisms of a conventional type can be provided, as are known to persons of ordinary skill in the art, for providing the functionality described herein.

In addition, the actuator 126 can be provided by a conventional actuation element such as a button, slide, knob, or the like configured for manipulating the locking member 130 for example, the actuator 126 can be provided by a pushbutton movable between a locked position (FIG. 8) in which it biases or retains the locking element 130 in its locked position and an unlocked position (FIG. 9) in which it biases or retains the locking element in its unlocked position. Typically, the actuator 126 is biased toward the locked position by a spring, for example such as that depicted. It will be understood that other types of actuators of a conventional type can be provided, as are known to persons of ordinary skill in the art, for providing the functionality described herein.

As noted above, the depth-adjustment mechanism includes an adjustable frame 124 that is slidably mounted to the receptacle-frame assembly 116 to adjust the floor panel 112 (supported by the adjustable frame) of the infant receptacle 104 between the raised and lowered positions. For example, the adjustable frame 124 can be generally horizontally arranged and slidably mounted and releasably locked to the vertical frame members 122 by the one or more lock mechanisms 125, as depicted. In this way, the vertical frame members 122 function as guide tracks along which the adjustable frame 124 is able to slide vertically between the raised and lowered positions as it supports the floor panel 112 of the infant receptacle 104. And the depth-adjustment mechanism can be configured to allow the adjustable frame 124 to travel up beyond the raised locking position, and the actuator 126 be released so the locking member 130 drops into the raised locking position and latches there to prevent false locking that if undetected could allow the adjustable frame to drop accidentally.

In other embodiments, the arrangement is vice versa, with the adjustable frame including vertical frame members that slide relative to fixed lock mechanisms. In other embodiments, the receptacle-frame assembly is integral to the peripheral sidewalls, for example the peripheral sidewalls can include at least an upper portion that is generally rigid with the receptacle frame considered to be defined by the peripheral wall. And in other embodiments, the peripheral sidewalls include rigid upper and lower portions with a guide track positioned between them and/or formed by one or both of them to enable the lower portion to slide vertically relative to the upper portion. It will be understood that other variations and configurations known to persons of ordinary skill in the art can be provided to enable the floor panel 112 of the infant receptacle 104 to move between the raised and lowered positions.

Figure 11:
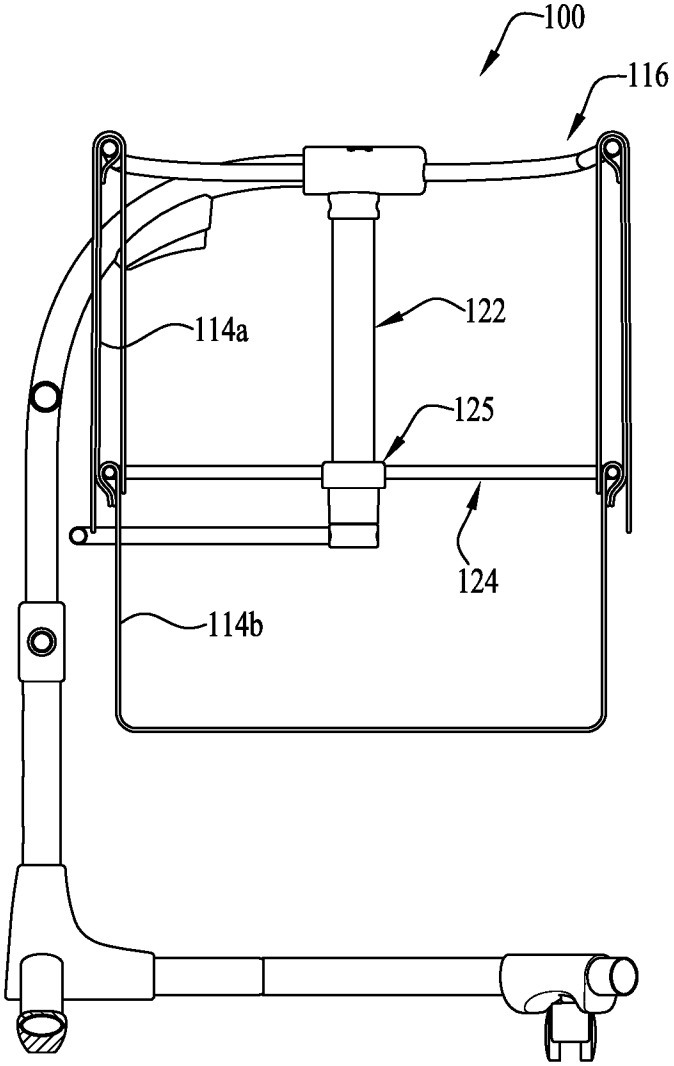
FIG. 11 is a cross-sectional view of the bassinet taken at line 11-11 of FIG. 2 with the child-receiving receptacle in the lowered-bottom position.
Figure 10:
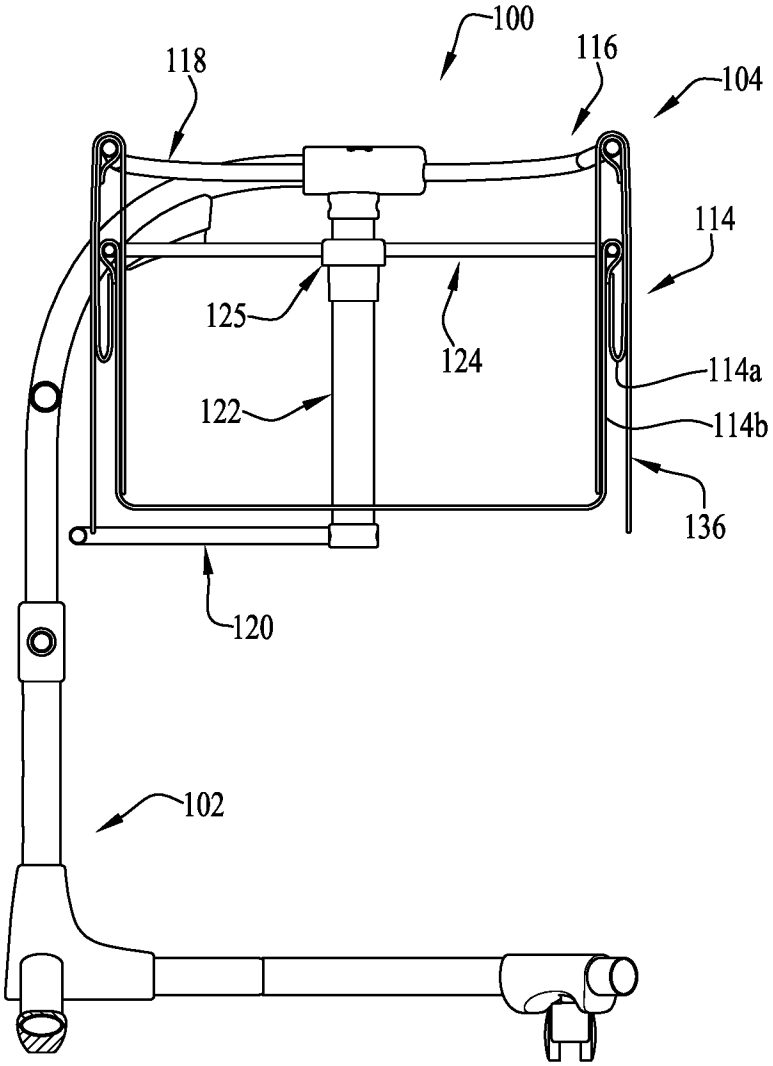
FIG. 10 is a cross-sectional view of the bassinet taken at line 10-10 of FIG. 1, showing the child-receiving receptacle in the raised-bottom position.

Furthermore, the peripheral sidewalls 114 can be provided in a variety of different configurations to enable the depth adjustment of the floor panel 112 of the infant receptacle 104. In the depicted embodiment, the peripheral sidewalls 114 include an upper portion 114*a* and a lower portion 114*b*, with the upper portion supported by the receptacle-frame assembly 116 (e.g., by the horizontal frame member 118), and with the lower portion 114*b* supported by the adjustable frame 124. The floor panel 112 is attached to and supported by the peripheral sidewalls lower portion 114*b*, and as such the floor panel is supported by and moves vertically with the adjustable member 124 between the raised and lowered positions. At least a portion of the peripheral sidewalls upper portion 114*a* is made of a flexible material (e.g., a fabric or other soft goods material) so that it folds over onto itself in a collapsed arrangement when the adjustable frame 124 (and thus also the peripheral sidewalls lower portion 114*b* and the floor panel 112) is moved to the raised position (FIG. 10) and so that it straightens out in an extended arrangement when the adjustable frame 124 is moved to the lowered position (FIG. 11). In other words, when the adjustable frame 124 is positioned in the raised position, the peripheral sidewalls 114 are shortened, reducing the depth of the infant receptacle 104. And when the adjustable frame 124 is positioned in the lowered position, the peripheral sidewalls 114 are lengthened, increasing the depth of the infant receptacle 104.

In addition, a valance 136 can be provided that extends between the upper frame 118 and the lower frame 120 of the receptacle-frame assembly 116 to form an outer wall of the infant receptacle 104 when in the raised position, and that is folded over the upper frame and extends down to adjacent the floor panel 112 to form an inner wall of the infant receptacle when in the raised position, with the valance thus covering the folded/bunched-up/collapsed peripheral sidewalls upper portion 114*a* in the raised position. That is, the inner wall of the valance 136 covers/contains the folded/bunched-up peripheral walls upper portion 114*a* as the floor panel 112 is moved up and down, and the outer wall of the valance covers the moving parts of the frame and adjustment assemblies. Optionally, the inner wall of the valance 136 (in its entirety, around the whole periphery of the infant receptacle 104) can be provided by a mesh fabric to provide breathability while still preventing child contact with the outer shell and the moving parts described above. Also, in embodiments with the depicted depth-adjustment mechanism, the outer wall of the valance 136 can include at least one vertically extending opening (e.g., one on each end of the infant receptacle 104) through which the lock mechanism 125 extends to couple the adjustable frame 124 to the receptacle frame and to permit the lock mechanism and adjustable frame to slide vertically along the receptacle frame.

In yet other embodiments, the peripheral sidewalls include a fixed rigid upper portion and a rigid lower portion that slides vertically relative to the upper portion, for example along a frame/guide track as described above. In other embodiments, the peripheral sidewall upper portion is not attached to the adjustable member, so it stays in its extended position when the peripheral sidewall lower portion and floor panel are moved to the raised position. In still other embodiments, the floor panel is fixed to the receptacle-frame assembly and an upper portion of the peripheral sidewall fixed to the adjustable frame so that the depth adjustment is achieved by raising the top of the infant receptacle instead of lowering its bottom. And in other embodiments, the peripheral sidewall upper sidewall portion and the inner or outer section of the valance are one and the same (i.e., only one of these elements is provided, regardless of the terminology used for it). It will be understood that other variations and configurations known to persons of ordinary skill in the art can be provided to enable the floor panel of the infant receptacle to move, relative to the open top of the infant receptacle, between the raised and lowered positions, with at least a portion of the peripheral sidewall attached to and vertically repositionable along with an adjustable member to decrease or increase the depth of the infant-receiving receptacle.

FIGS. 13-17 show a bassinet 200 according to a second example embodiment of the invention. The bassinet 200 includes a support-frame assembly 202 configured to rest on a support surface (e.g., a floor or the ground) and an infant-receiving receptacle (not shown) coupled to the support frame assembly and adapted to support a child (e.g., infant) therein. The bassinet 200 is thus substantially similar to that of the first example embodiment, so details are not repeated for brevity. As such, the bassinet 200 can include (or not) a depth-adjustment mechanism for adjusting the depth of the infant receptacle by adjusting the vertical position of its floor panel, for example as described with respect to the first embodiment. Also, the bassinet 200 can include (or not) any of the other features of the various embodiments described herein.

In this embodiment, the bassinet 200 includes a frame height-adjustment mechanism that adjusts the height of the support-frame assembly 202 and thus the attached infant receptacle (i.e., the vertical position of its top and bottom, not just its bottom/depth). In the depicted embodiment, the upright portion 208 of the support-frame assembly 202 includes lower upright frame in 208*a* and upper upright frame members 208*b* that extend and retract relative to the respective lower frame members (e.g., telescopically) between respective raised and lowered positions of the infant receptacle. The height-adjustment mechanism includes at least one lock mechanism to 242 for securing the upper and lower frame members 208*a* and 208*b* in the raised and lowered positions and for releasing them to permit movement between those positions. For example, two lock mechanisms 242 can be provided, one for each of the left and right upright frame members 208. And each lock mechanism 242 can include a movable locking element 244 that is spring-biased toward locking engagement with at least one locked element 246 in a locked position and that is disengaged from the locked element to permit relative movement between the upper and lower frame members 208*a* and 208*b* in an unlocked position. The movable locking element 244 can be provided by a male lock element such as pivotal tab (as depicted), a reciprocal plunger, a rotary knob, or the like attached to one of the upper and lower frame members 208*a* and 208*b*, and the locked element 246 can be provided by a plurality of female lock elements such as holes (as depicted), recesses, or the like defined by the other one of the upper and lower frame members.

Furthermore, an actuator 240 can be provided for manipulating the lock mechanisms 242 between the locked and unlocked positions. For example, two actuators 240 can be provided, each one for operating a respective one of the lock mechanisms 242. Each actuator 240 can be provided for example by a pivotal arm (as depicted) or other conventional actuator (e.g., a slide, knob, pushbutton) that moves between locked and unlocked positions to manipulate the lock mechanism 242 between the lock and unlock positions. The actuator 240 can be operably connected to the movable locking element 244 by a mechanical link such as the depicted connecting cable or a mechanical linkage, or the actuator can directly contact the locking element in other embodiments.

In this way, the height-adjustment mechanism enables a caretaker to adjust the overall height of the infant receptacle to provide enhanced flexibility of use, particularly (but not only) when the bassinet also includes the depth-adjustment mechanism. For example, this enables the height and/or depth of the infant receptacle to be adjusted so that the infant receptacle can be positioned over (or adjacent) taller or shorter beds (or couches) and still have the infant positioned just above the bed for enhanced parental bonding.

In a typical commercial embodiment, the upper frame member is about 34 inches high, when fully extended/raised, and drops to a height of about 29 inches when the height-adjust is moved to its lowest setting. Also, at its shortest depth, the bassinet receptacle is about 12 inches deep, and adjusting the depth to the deepest setting adds about 9 inches of depth (for a total depth of about 21 inches). As such, the bottom/floor panel (the infant resting surface) has a top height of about 22 inches from the ground and a lowest height (with the frame at the lowest height setting, and the depth at the deepest setting) of about 8 inches from the ground. These dimensions are representative and provided for illustration purposes only, and as such are not limiting of the invention as claimed.

Figure 13:
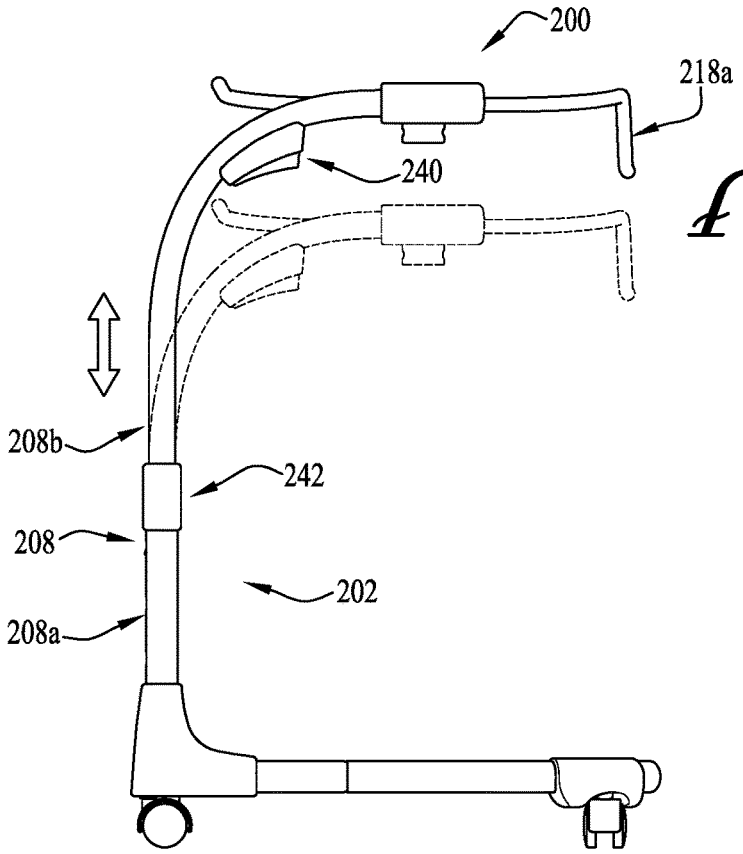
FIG. 13 is a left side view of a frame of a bassinet according to a second example embodiment of the invention, showing the bassinet frame and the attached child-receiving receptacle adjusted between raised and lowered heights by a height-adjustment mechanism.
Figure 12:
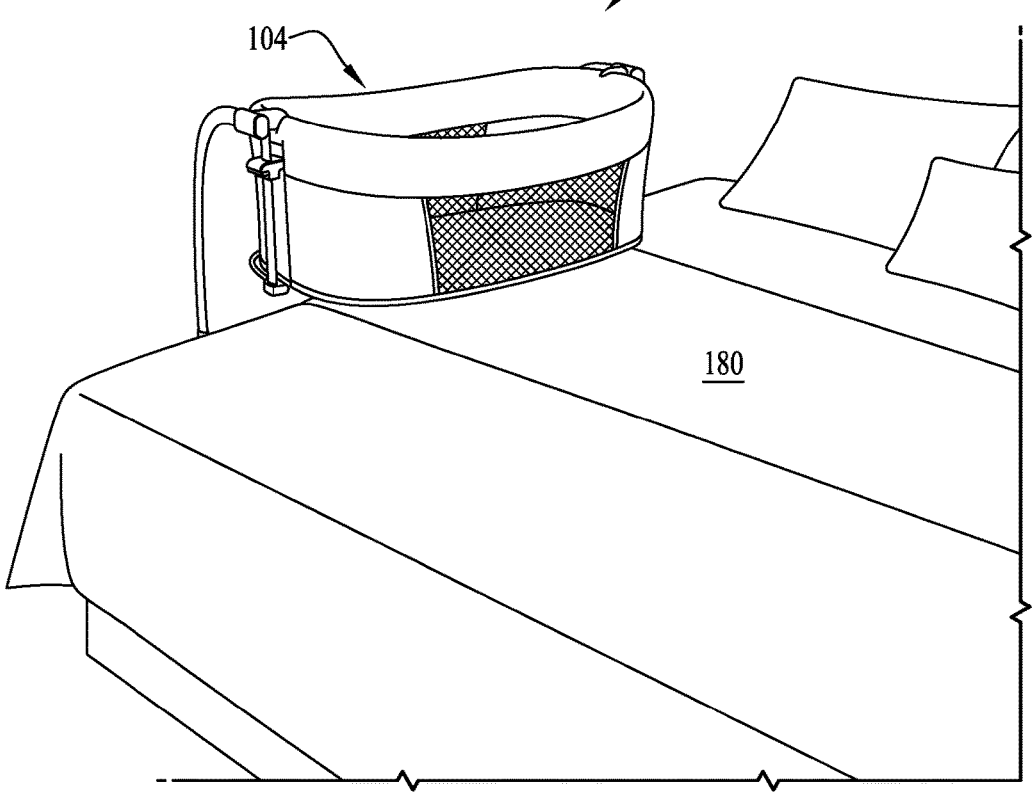
FIG. 12 is a perspective view of the bassinet of FIG. 1 shown in the raised-bottom position with the child-receiving receptacle positioned over a parent's bed.
Figure 14:
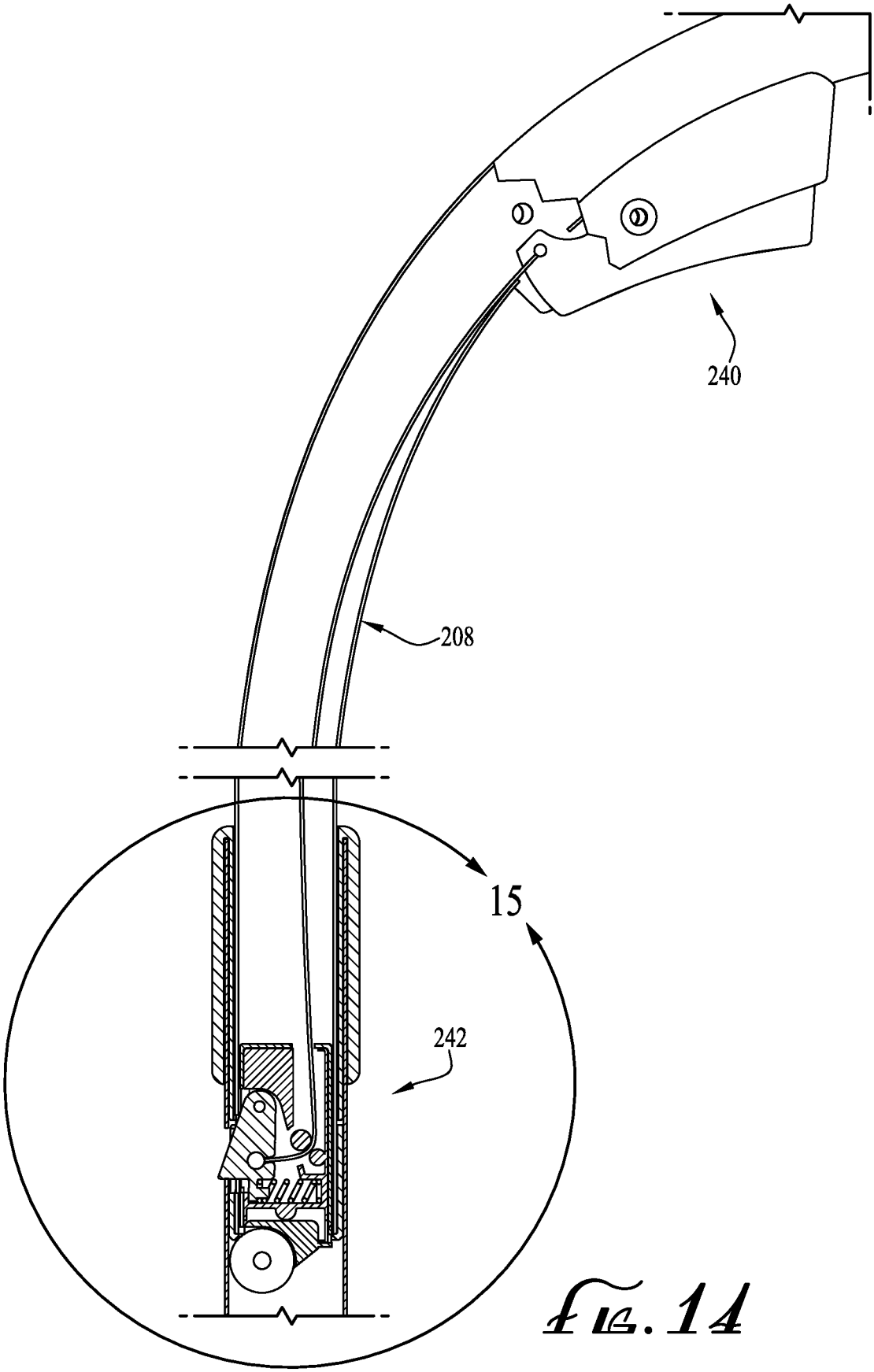
FIG. 14 is a left side view of a portion of the bassinet frame of FIG. 13, showing the height-adjustment mechanism in cross-section (as indicated in FIG. 17) to reveal interior components thereof.
Figure 15:
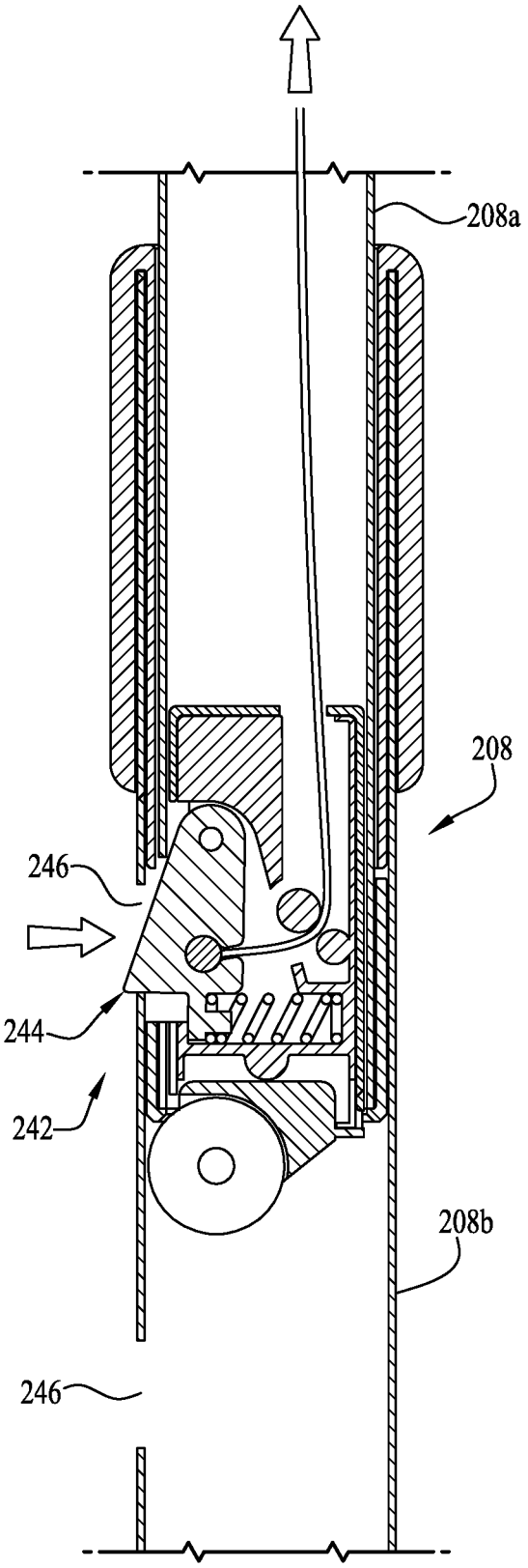
FIG. 15 shows a detail of the height-adjustment mechanism of FIG. 13, showing the height-adjustment mechanism holding the bassinet frame in the raised position.
Figure 16:
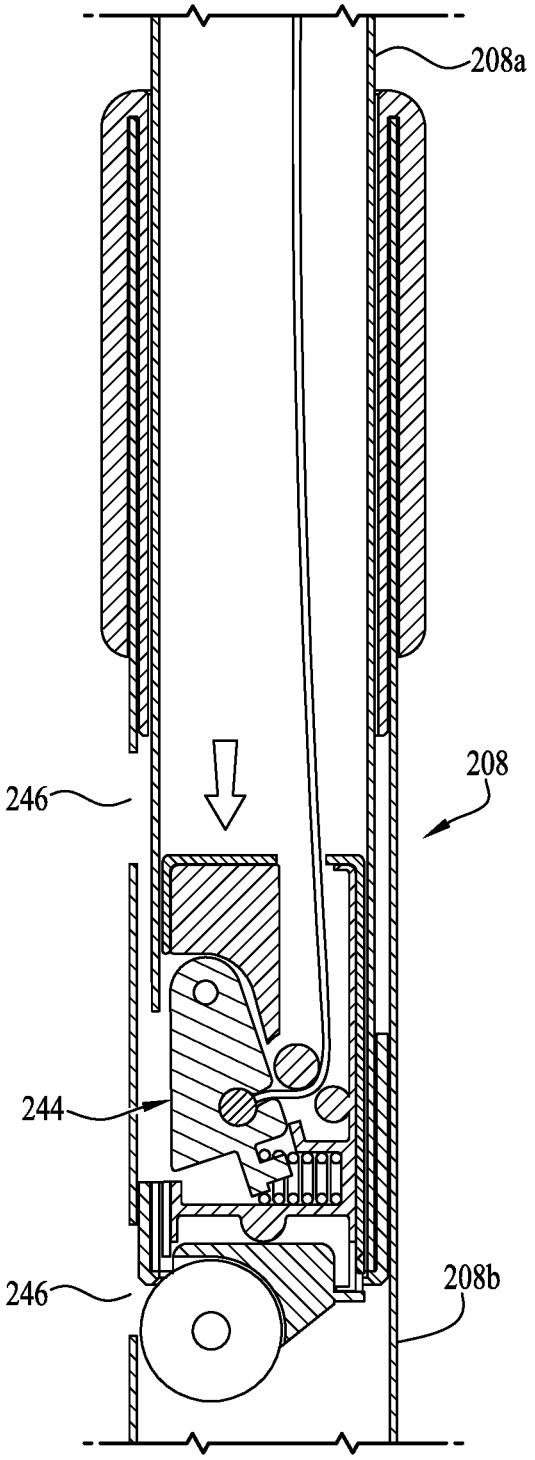
FIG. 16 shows the height-adjustment mechanism of FIG. 15 showing the height-adjustment mechanism being operated to move the bassinet frame to the lowered position.
Figure 17:
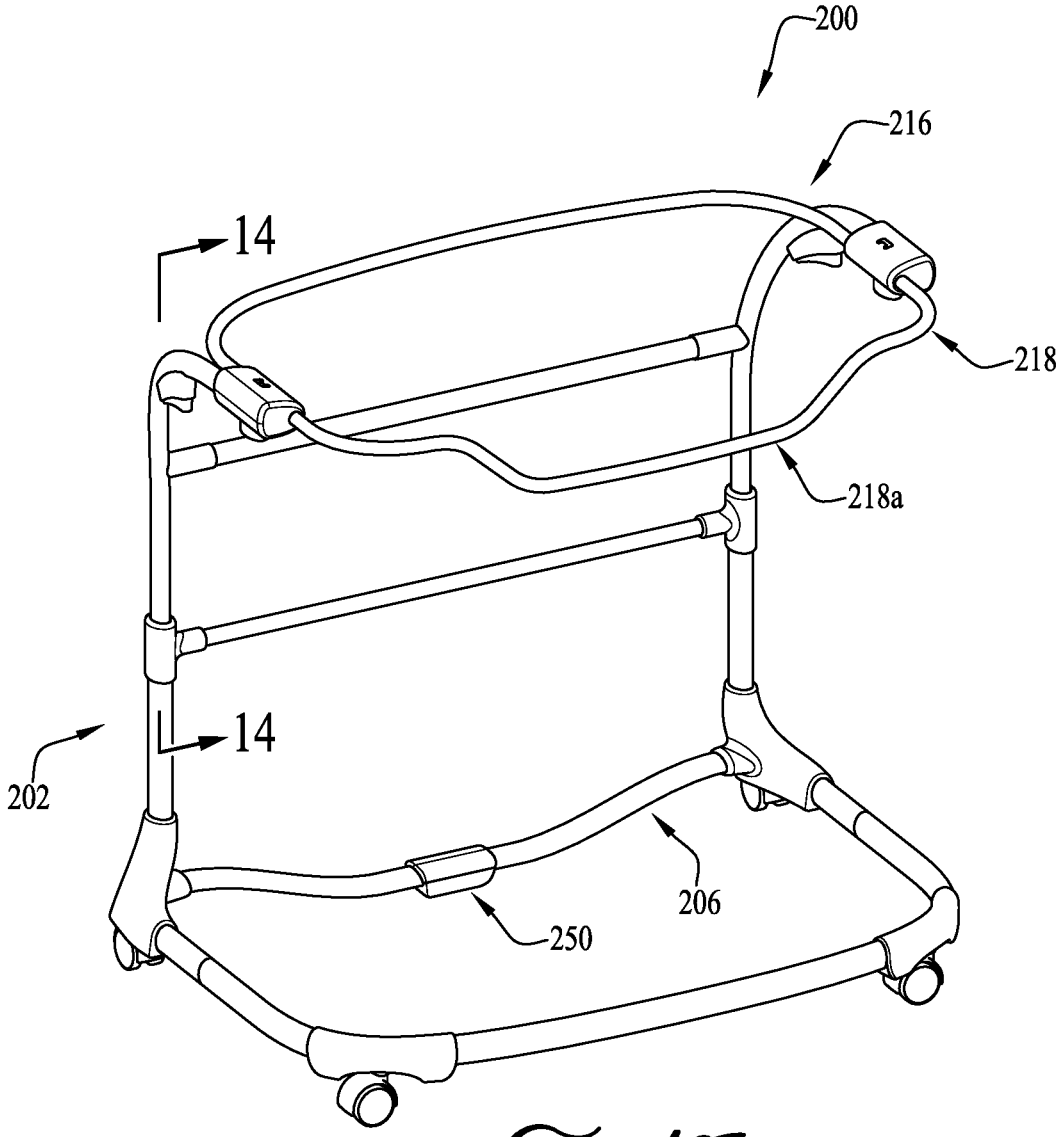
FIG. 17 is a perspective view of a portion of the bassinet frame of FIG. 13, showing a downwardly recessed front portion of the peripheral wall of the child-receiving receptacle according to another aspect of the invention.

Furthermore, as shown particularly in FIGS. 13 and 17, in another aspect the bassinet 200 can include a downward recess in the top of the front wall panel of the peripheral sidewall to provide increased lateral visibility into the infant receptacle and to thereby assist in enhancing parent-child bonding. In the depicted embodiment, for example, the upper frame 218 of the receptacle-support frame 216 has a downwardly recessed segment 218*a* in its front side, and the front portion of the peripheral wall (not shown) that is supported by and extends downward from this segment is thus also downwardly recessed. In this way, the space between the plane defined by the recessed segment 218*a* and the rest of the upper frame 218 is open (not covered by the peripheral sidewalls) for enhanced visibility. Optionally, the front side of the upper frame can include the downwardly recessed segment and a flexible peripheral sidewall (not shown) can be stretched taut straight across it and thus not recessed with/by it (and not supported by the upper frame), enabling a caretaker to push down on the peripheral sidewall adjacent the recessed segment to downwardly recess it to a lowered position for visibility into the infant receptacle then release it to resiliently return it to its taut, straight across, raised position.

Moreover, as shown particularly in FIG. 17, in another aspect the bassinet 200 can include a foot rest 250 on the base portion 206 of the support-frame assembly 202. For example, the foot rest 250 can be in the form of a pad or pedal fixed in place on a rear structural crossmember of the support-frame base 206. In this way, a caregiver can rest their foot on the foot rest 250 when operating the depth-adjustment mechanism and/or the height-adjustment mechanism for repositioning the floor panel of the infant receptacle and/or the overall infant receptacle itself from respective lowered positions upward toward respective raised positions.

Figure 19:
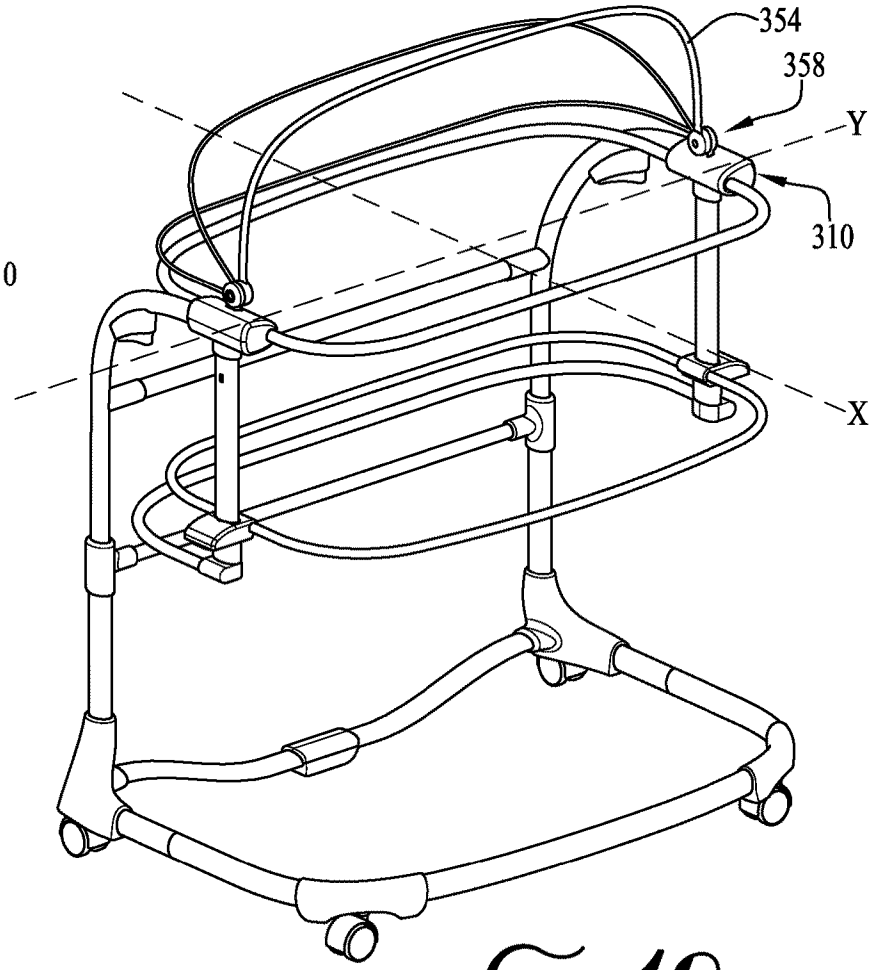
FIG. 19 is a perspective view of a frame of the bassinet of FIG. 18.
Figure 18:
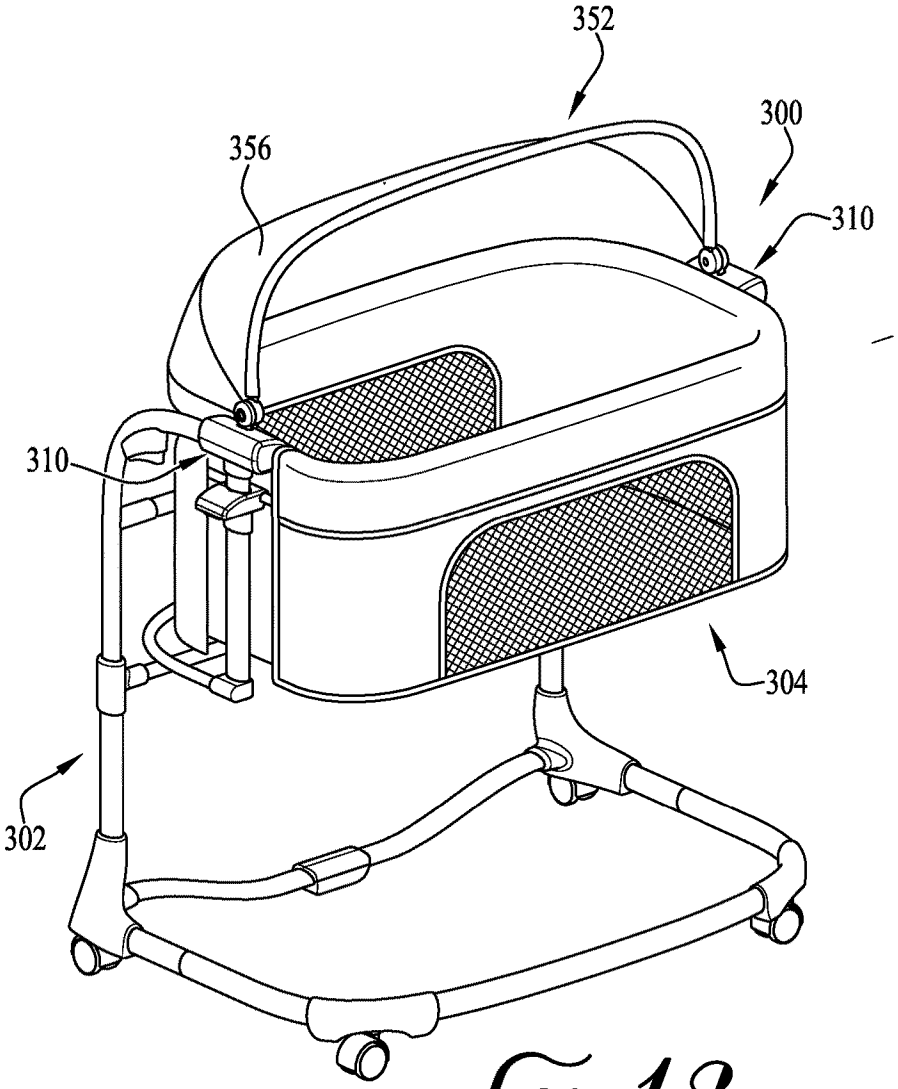
FIG. 18 is a perspective view of a bassinet according to a third example embodiment of the invention, showing a longitudinal-axis folding canopy for the child-receiving receptacle, with the canopy unfolded in a deployed/covering position.

FIGS. 18-19 show a bassinet 300 according to a third example embodiment of the invention. The bassinet 300 includes a support-frame assembly 302 configured to rest on a support surface (e.g., a floor or the ground) and an infant-receiving receptacle 304 coupled to the support frame assembly and adapted to support a child (e.g., infant) therein. The bassinet 300 is thus substantially similar to that of the first example embodiment, so details are not repeated for brevity. As such, the bassinet 300 can include (or not) a depth-adjustment mechanism for adjusting the depth of the infant receptacle 304 by adjusting the vertical position of its floor panel, for example as described with respect to the first embodiment. Also, the bassinet 300 can include (or not) any of the other features of the various embodiments described herein.

In this embodiment, the bassinet 300 includes longitudinal-axis folding canopy 352 to assist in enhancing parent-child bonding. In typical embodiments, the canopy 352 includes a framework 354 attached (e.g., removably) to the bassinet 300 (e.g., to the support-frame assembly 302) and a shell 356 supported by the framework. For example, the framework 354 can include at least two (e.g., the three depicted) support ribs with one or more of the ribs pivotal between an extended/up position covering (relatively more of) the infant receptacle 304 (as depicted) and a collapsed/down position uncovering (covering relatively less of) the infant receptacle (not shown). As opposed to a conventional bassinet canopy that covers the head end (one of the relatively shorter peripheral sidewalls) of an infant receptacle and folds about a transverse/shorter axis (extending between the opposing longer sides) X of the infant receptacle, the canopy 352 folds about a longitudinal/longer axis (extending between the opposing shorter sides) Y of the infant receptacle 304. For example, the support ribs of the framework 354 can attach, at attachments 358, to the mounts 310 for the infant receptacle 304 to the support-frame assembly 302, which mounts (and thus which attachments) can be positioned at approximate midpoints of (or other points along) the two opposing ends of the infant receptacle, as depicted. In this way, when the canopy 352 is deployed into the extended/up position, the bassinet 300 can be positioned over (or adjacent) a bed or couch, provide better visibility for a caretaker on the bed looking into the infant receptacle 304, and still shade the child from bright light. In other embodiments, the longitudinal-axis folding canopy includes two frameworks and respective shells in a clamshell arrangement that in their extended/up positions are adjacent to each other to substantially cover the infant receptacle.

Figure 20:
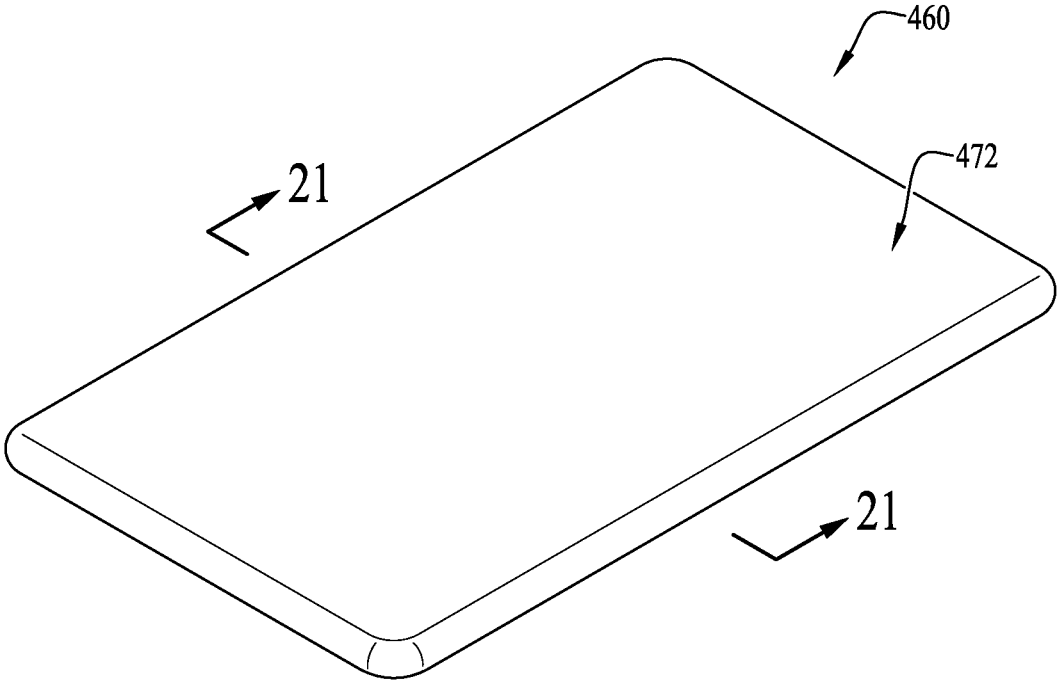
FIG. 20 is a perspective view of a bed pad for the bottom/floor panel of a bassinet according to a fourth example embodiment of the invention.
Figure 21:
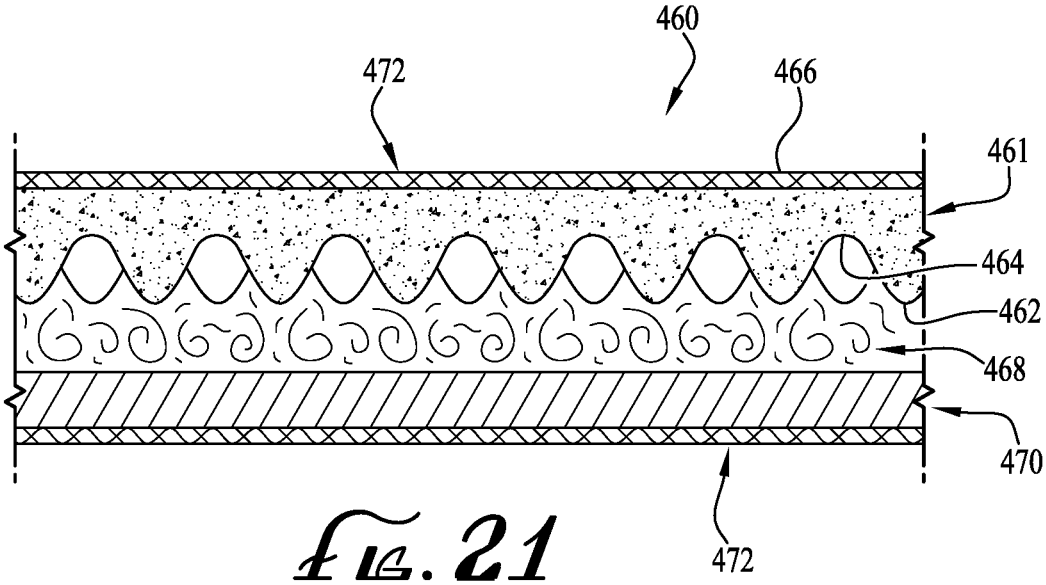
FIG. 21 is a cross-sectional view of the bed pad of the bassinet taken at line 21-21 of FIG. 20.

FIGS. 20-21 show a bed pad 460 of a bassinet (not shown) according to a fourth example embodiment of the invention. The bassinet can be of the same type is any described herein or it can be a conventional or other new bassinet. The bed pad 460 is supported on the floor panel (not shown) of the infant receptacle (not shown). For example, the bed pad 460 can rest upon the floor panel without being attached to anything, or it can be attached to the floor panel, the peripheral sidewalls, the adjustable frame, the receptacle-frame assembly, and/or another component of the bassinet, as may be desired.

The bed pad 460 includes a conventional "eggcrate" foam slab 461 of a type known in the art, for example acoustic/waffle foam. As such, the eggcrate foam 461 includes a first surface 462 with open cells 464 in a staggered/alternating row-by-row arrangement, and a second opposite surface 466 that is typically (but not necessarily) generally flat. Instead of the eggcrate foam 461 being oriented with the open cells 464 of the first undulating surface 462 facing upward, as is conventionally done, the eggcrate foam is oriented in an inverted position with its first undulating side and open cells facing downward. In addition, the inverted eggcrate foam 461 is positioned on top of batting 468 (with the open cells 464 receiving at least some of the batting), which in turn is positioned on top of a support board 470, with the foam, batting, and board enclosed in a shell (e.g., fabric) 472. In this innovative arrangement of components, the bed pad 460 provides more cushioning effect and/or less material/space for enhanced comfort for the child lying on it.

Figure 22:
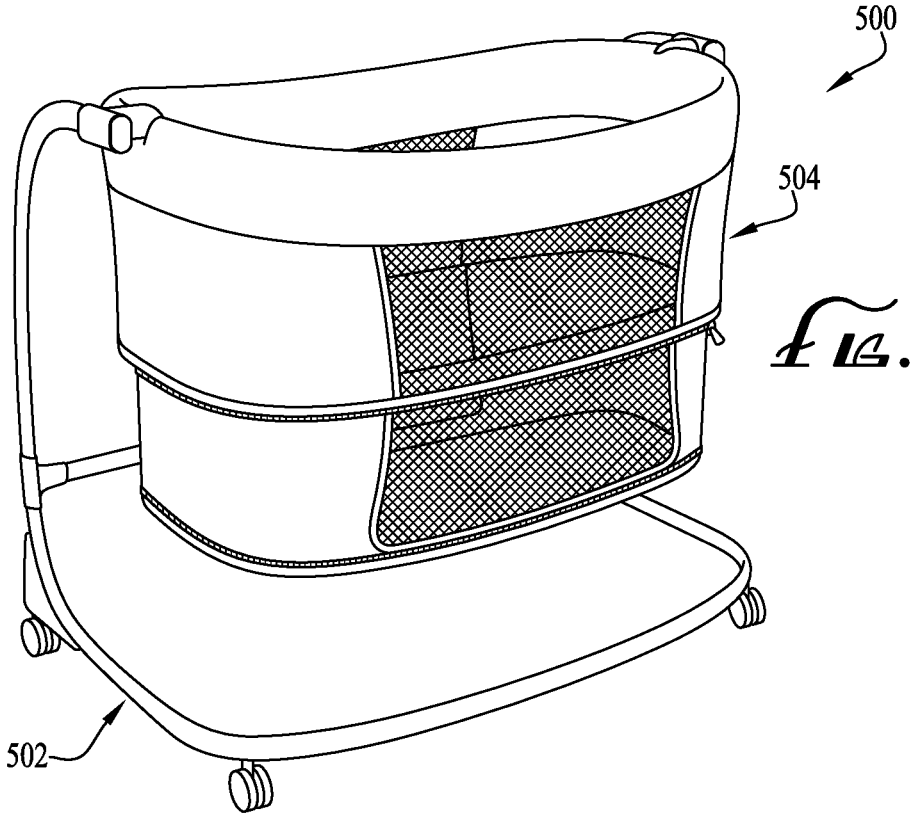
FIG. 22 is a perspective view of a bassinet according to a fifth example embodiment of the invention, showing a zipper-type depth-adjustment mechanism with the bassinet in the lowered position.
Figure 23:
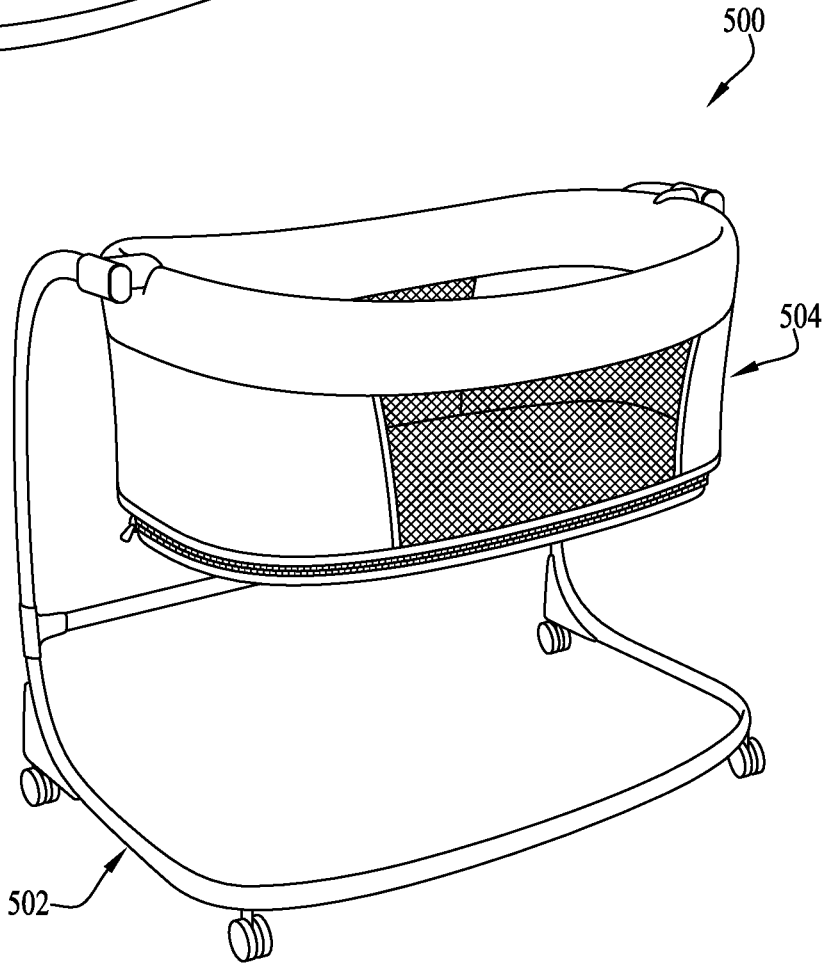
FIG. 23 shows the bassinet of FIG. 22 in the raised position.

FIG. 22-23 show a bassinet according to a fifth example embodiment of the invention. The bassinet 500 includes a support-frame assembly 502 configured to rest on a support surface (e.g., a floor or the ground) and an infant-receiving receptacle 504 coupled to the support frame assembly and adapted to support a child (e.g., infant) therein. The bassinet 500 is thus substantially similar to that of the first example embodiment, so details are not repeated for brevity. As such, the bassinet 500 can include (or not) a depth-adjustment mechanism for adjusting the depth of the infant receptacle 504 by adjusting the vertical position of its floor panel, for example as described with respect to the first embodiment. Also, the bassinet 500 can include (or not) any of the other features of the various embodiments described herein.

In this embodiment, the peripheral sidewalls include upper and lower portions, with at least one of them having a flexible portion that collapses in the raised position and that extends in the lowered position. Also, the lock mechanism of the depth-adjustment mechanism is in the form of a conventional zipper mechanism 525 including two inter-engaging zipper strips spaced apart with the flexible sidewall portion between them. When the zipper head is moved through a zipping path to cause the two zipper strips to pull toward each other, the flexible portion is collapsed and the floor panel is thereby raised. In this way, when the zipper head is in the zipped position, the floor panel is locked in the raised position. And when the zipper head is moved through an unzipping motion to allow the two zipper strips to pull away from each other, the flexible sidewall portion is extended and the floor panel is thereby lowered. In this way, when the zipper head is in the unzipped position, the floor panel is unlocked and free to fall by gravity to the lowered position.

While the invention has been described with reference to typical and example embodiments, it will be understood by those skilled in the art that a variety of modifications, additions and deletions are within the scope of the invention, as defined by the following claims.

What is claimed is:

1. An adjustable-depth bassinet, comprising:

a support-frame assembly configured to rest on a support surface;

an infant-receiving receptacle coupled to the support-frame assembly and including a floor panel and a peripheral sidewall together forming an enclosure with an open top and a depth, wherein the infant-receiving receptacle is adapted to receive and support a child therein; and a depth-adjustment mechanism including a zipper assembly having an upper zipper strip and a lower zipper strip attached to the infant-receiving receptacle at vertically spaced-apart positions with a flexible portion of the infant-receiving receptacle positioned between the two zipper strips so that when the two zipper strips are engaged together the flexible portion is cinched with the floor panel in a raised planar position and when the two zipper strips are disengaged the flexible portion uncinches and extends to enable the floor panel to move to a lowered planar position.

2. The adjustable depth bassinet of claim 1, wherein the infant-receiving receptacle is pivotally coupled to the support-frame assembly to allow a rocking motion of the infant-receiving receptacle relative to the support-frame assembly.

3. The adjustable depth bassinet of claim 1, wherein the floor panel of the receptacle is repositionable from between about 8" to about 22" from the support surface.

4. The adjustable depth bassinet of claim 1, wherein the depth of the receptacle enclosure is adjustable from between about 12" deep to about 21" deep.

5. The adjustable depth bassinet of claim 1, wherein the depth of the receptacle enclosure is adjustable by at least about 9".

6. The adjustable depth bassinet of claim 1, further comprising a bed pad configured for placement in the infant-receiving receptacle, the bed pad comprising an eggcrate foam slab having an undulating lower surface with a plurality of downward facing open cells; a batting material at least partially received within the downward facing open cells of the eggcrate foam slab; a support board beneath the batting; and a fabric shell enclosing the eggcrate foam slab, the batting material and the support board.

7. The adjustable-depth bassinet of claim 1, wherein the support-frame assembly includes a base portion that rests on the support surface and an upright portion extending upward from the base portion and to which the infant-receiving receptacle is mounted.

8. The adjustable-depth bassinet of claim 7, wherein the upright portion of the support frame is adjustable to allow raising and lowering of the receptacle relative to the support surface.

9. The adjustable depth bassinet of claim 8, wherein adjustment of the upright portion of the support frame allows raising and lowering of the receptacle from between about 29" to about 34" above the support surface.

10. The adjustable-depth bassinet of claim 1, wherein the base portion comprises wheels allowing the bassinet to be rolled across the support surface.

11. A collapsible bassinet comprising:

a support frame configured to rest on a support surface, the support frame comprising one or more wheels, a base support portion, and an upright support portion wherein the base portion is supported by the one or more wheels on the support surface and the upright support portion extends upwardly from the base support portion;

a child receptacle configured to receive and support a child therein, the receptacle comprising an upper frame portion, a floor panel, and a peripheral sidewall extending between the upper frame portion and the floor panel, wherein the child receptacle is secured to the upright support portion; and a depth-adjustment mechanism including a zipper assembly having an upper zipper strip and a lower zipper strip attached to the child receptacle at vertically spaced-apart positions with a flexible portion of the child receptacle positioned between the two zipper strips so that when the two zipper strips are engaged together the flexible portion is cinched with the floor panel in a first position and when the two zipper strips are disengaged the flexible portion uncinches and extends to enable the floor panel to move to a second position, wherein the floor panel is parallel to the support surface in the first and second positions, and wherein the upright support portion is adjustable to allow raising and lowering of the child receptacle relative to the support surface and an upper surface of an adult bed.

12. The collapsible bassinet of claim 11, wherein the child receptacle is pivotally coupled to the support frame to allow a rocking motion of the receptacle relative to the support frame.

13. The collapsible bassinet of claim 11, wherein adjustment of the upright support portion of the support frame allows raising and lowering of the child receptacle from between about 29" to about 34" above the support surface.

14. The collapsible bassinet of claim 11, wherein the floor panel of the child receptacle is repositionable from between about 8" to about 22" from the support surface.

15. The collapsible bassinet of claim 11, wherein a depth of the child receptacle is adjustable from between about 12" deep to about 21" deep.

16. The collapsible bassinet of claim 11, wherein a depth of the child receptacle is adjustable by at least about 9".

17. The collapsible bassinet of claim 11, further comprising a bed pad configured for placement in the child receptacle, the bed pad comprising an eggcrate foam slab having an undulating lower surface with a plurality of downward facing open cells; a batting material at least partially received within the downward facing open cells of the eggcrate foam slab; a support board beneath the batting; and a fabric shell enclosing the eggcrate foam slab, the batting material and the support board.

* * * * *